US009539818B2

(12) United States Patent
Ando

(10) Patent No.: US 9,539,818 B2
(45) Date of Patent: Jan. 10, 2017

(54) LIQUID EJECTING APPARATUS AND PRESSURIZING/DEPRESSURIZING METHOD THEREOF

(71) Applicant: SEIKO EPSON CORPORATION, Tokyo (JP)

(72) Inventor: Masaaki Ando, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/474,878

(22) Filed: Sep. 2, 2014

(65) Prior Publication Data

US 2015/0085025 A1 Mar. 26, 2015

(30) Foreign Application Priority Data

Sep. 20, 2013 (JP) ..... 2013-194739

(51) Int. Cl.

| | |
|---|---|
| ***B41J 2/175*** | (2006.01) |
| ***B41J 2/18*** | (2006.01) |
| ***B41J 29/38*** | (2006.01) |
| *B41J 2/17* | (2006.01) |
| *B41J 2/19* | (2006.01) |

(Continued)

(52) U.S. Cl.

CPC *B41J 2/175* (2013.01); *B41J 2/18* (2013.01); *B41J 29/38* (2013.01); *B41J 2/055* (2013.01); *B41J 2/1652* (2013.01); *B41J 2/16526* (2013.01); *B41J 2/17556* (2013.01); *B41J 2/19* (2013.01)

(58) Field of Classification Search

CPC ..... B41J 2/055; B41J 2/18; B41J 2/19; B41J 2/17556; B41J 2/1652; B41J 2/16526

USPC ..... 347/84, 85, 89, 92–94

See application file for complete search history.

(56) References Cited

U.S. PATENT DOCUMENTS

| | | | | |
|---|---|---|---|---|
| 5,801,735 | A * | 9/1998 | Lorenze et al. | 347/85 |
| 6,705,711 | B1 * | 3/2004 | Richards | 347/85 |
| 7,261,399 | B2 * | 8/2007 | Miki | 347/85 |

(Continued)

FOREIGN PATENT DOCUMENTS

| | | | |
|---|---|---|---|
| JP | 2010-208186 | A | 9/2010 |
| JP | 2011-255538 | A | 12/2011 |

OTHER PUBLICATIONS hydraulicspneumatics.com (Book 2, Chapter 1: Hydraulic Accumulators (part 1)), downloaded from: http://hydraulicspneumatics.com/other-technologies/book-2-chapter-1-hydraulic-accumulators-part-1 ?page=1 on Mar. 7, 2016.*

*Primary Examiner* — Jannelle M Lebron
*Assistant Examiner* — Jeremy Bishop
(74) *Attorney, Agent, or Firm* — Global IP Counselors, LLP

(57) ABSTRACT

A pressurizing/depressurizing method of a liquid ejecting apparatus which includes a print head which ejects liquid, and a supply unit which supplies the liquid to the print head, the method including depressurizing/pressure accumulating in which a depressurization buffer tank is depressurized, and a pressure is accumulated; pressurizing/pressure accumulating in which a pressurization buffer tank is pressurized, and a pressure is accumulated; depressurizing in which the liquid is depressurized so that a pressure is lower than an atmospheric pressure in the supply unit using the depressurization buffer tank; and pressurizing in which the liquid is pressurized so that the pressure is higher than the atmospheric pressure in the supply unit using the pressurization buffer tank.

12 Claims, 10 Drawing Sheets

(51) Int. Cl.
*B41J 2/055* (2006.01)
*B41J 2/165* (2006.01)

(56) References Cited

U.S. PATENT DOCUMENTS

| | | | | |
|---|---|---|---|---|
| 7,909,443 | B2 * | 3/2011 | Hirato | 347/85 |
| 8,104,855 | B2 * | 1/2012 | Tamaki et al. | 347/7 |
| 8,142,003 | B2 * | 3/2012 | Tamaki | 347/92 |
| 8,393,696 | B2 * | 3/2013 | Leighton et al. | 347/7 |
| 8,430,490 | B2 * | 4/2013 | Morita | B41J 2/175 347/5 |
| 8,491,075 | B2 * | 7/2013 | Zhou et al. | 347/10 |
| 2011/0298875 | A1 | 12/2011 | Kobashi et al. | |

* cited by examiner

LIQUID EJECTING APPARATUS AND PRESSURIZING/DEPRESSURIZING METHOD THEREOF

BACKGROUND

1. Technical Field

The present invention relates to a technology of pressurizing and depressurizing in which a pressurizing process of pressurizing liquid, and a depressurizing process of depressurizing liquid are performed in a liquid ejecting apparatus which ejects liquid such as ink from nozzles of a print head.

2. Related Art

In the related art, a liquid ejecting apparatus such as a printer which ejects liquid such as ink from nozzles of a print head has been known. In such an apparatus, there is a case in which ejecting of liquid is not appropriately performed due to bubbles in liquid, and for example, a quality of printing using liquid deteriorates. Therefore, for example, in an apparatus disclosed in JP-A-2010-208186, a depressurizing pump is operated after ending a printing operation, and deaeration processing is executed by pressurizing liquid (depressurizing process).

In addition, since it is not possible to perform good liquid ejection when bubbles or foreign substances are mixed into nozzles, for example, a printing quality deteriorates. Therefore, in an apparatus disclosed in JP-A-2010-255538, bubbles are discharged from nozzles by pressurizing ink in an ink supply tube using a pressurizing pump (pressurizing process).

In order to perform high quality printing, it is desirable to perform the above described pressurizing process and depressurizing process. In order to perform these processes, it is necessary to operate a pressurizing pump in every pressurizing process by operating the pressurizing pump in every depressurizing process. However, a value of a positive pressure or a negative pressure which is applied from the pump is unstable immediately after starting the operation of the pump. In addition, there is a case in which it is difficult to preferably perform pressurizing and depressurizing, when the operation of the pump is limited due to an operational condition of an apparatus, or the like.

SUMMARY

An advantage of some aspects of the invention is to provide a liquid ejecting apparatus which ejects liquid supplied from a supply unit from nozzles of a print head, in which a depressurizing process in which a pressure of the liquid is depressurized so as to be lower than atmospheric pressure in the supply unit, and a pressurizing process in which the pressure of the liquid is pressurized so as to be higher than the atmospheric pressure in the supply unit are preferably performed.

According to an aspect of the invention, there is provided a pressurizing/depressurizing method of a liquid ejecting apparatus which includes a print head which ejects liquid, and a supply unit which supplies the liquid to the print head, the method including depressurizing/pressure accumulating in which a depressurization buffer tank is depressurized, and a pressure is accumulated; pressurizing/pressure accumulating in which a pressurization buffer tank is pressurized, and a pressure is accumulated; depressurizing in which the liquid is depressurized so that a pressure is lower than an atmospheric pressure in the supply unit using the depressurization buffer tank; and pressurizing in which the liquid is pressurized so that the pressure is higher than the atmospheric pressure in the supply unit using the pressurization buffer tank.

According to another aspect of the invention, there is provided a liquid ejecting apparatus which includes a print head which ejects liquid from nozzles; a supply unit which supplies the liquid to the print head; a depressurization buffer tank which accumulates a pressure by performing depressurizing; a pressurization buffer tank which accumulates a pressure by performing pressurizing; a depressurization path which communicates with the supply unit and the depressurization buffer tank; and a pressurization path which communicates with the supply unit and the pressurization buffer tank, in which the supply unit depressurizes a pressure of liquid so as to be lower than an atmospheric pressure using the depressurization buffer tank, and pressurizes the pressure of the liquid so as to be higher than the atmospheric pressure using the pressurization buffer tank.

In the invention which is configured in this manner, accumulating of a negative pressure is prepared in advance by depressurizing a depressurization buffer tank. In addition, a depressurizing process of liquid is performed using the depressurization buffer tank. Accordingly, it is possible to stably depressurize liquid at appropriate timing, and the depressurizing process is preferably performed. In addition, the same is applied to pressurizing. That is, accumulating of a positive pressure is prepared in advance by pressurizing a pressurization buffer tank. In addition, a pressurizing process of liquid is performed using the pressurization buffer tank. Accordingly, it is possible to stably pressurize liquid at appropriate timing, and the pressurizing process is preferably performed.

Here, it is possible to miniaturize the apparatus by performing a depressurizing/pressure accumulating process and a pressurizing/pressure accumulating process using the same pump, and to suppress a cost of the apparatus.

In the pressurizing/depressurizing method, the depressurizing process may be controlled by a first switching unit, and the pressurizing process may be controlled by a second switching unit, when pressurizing and depressurizing are performed using a pump as described above. As the first switching unit, it is possible to use a unit which switches between a depressurization position at which an inlet port of the pump and the depressurization buffer tank are communicated and a depressurization stop position at which the inlet port of the pump and an atmospheric pressure are communicated, and a configuration in which the depressurizing/pressure accumulating process is executed by switching the first switching unit to the depressurization position may be adopted. In addition, as the second switching unit, it is possible to use a unit which switches between a pressurization position at which an outlet port of the pump and the pressurization buffer tank are communicated and a pressurization stop position at which the outlet port of the pump and an atmospheric pressure are communicated, and a configuration in which the pressurizing/pressure accumulating process is executed by switching the second switching unit to the pressurization position may be adopted.

In the pressurizing/depressurizing method, when the depressurizing/pressure accumulating is stopped while the pressurizing/pressure accumulating is executed by switching the second switching unit to the pressurization position, there is a possibility that an excessive pressure is applied to the inlet port side of the pump. However, the applying of pressure may be relieved by performing an atmosphere release by switching the first switching unit to the depressurization stop position.

In the pressurizing/depressurizing method, when the pressurizing/pressure accumulating process is stopped while the depressurizing/pressure accumulating is executed by switching the first switching unit to the depressurization position, there is a possibility that an excessive pressure is applied to the outlet port side of the pump, however, the applying of pressure may be relieved by performing an atmosphere release by switching the second switching unit to the pressurization stop position.

In the pressurizing/depressurizing method, the depressurizing/pressure accumulating and the pressurizing/pressure accumulating may be selectively performed, and the depressurizing/pressure accumulating and the pressurizing/pressure accumulating may be performed in parallel by switching the first switching unit to the depressurization position, and switching the second switching unit to the pressurization position. When performing the processes in parallel in this manner, it is possible to reduce a total time which is necessary when performing pressurizing/pressure accumulating with respect to the pressurization buffer tank and depressurizing/pressure accumulating with respect to the depressurization buffer tank.

In the pressurizing/depressurizing method, excessive depressurizing inside the depressurization buffer tank may be prevented by stopping the depressurizing/pressure accumulating when the inside of the depressurization buffer tank is depressurized so as to be a first pressure value. In addition, it is possible to minimize a time necessary until a negative pressure is accumulated in the depressurization buffer tank, and to efficiently perform the depressurizing/pressure accumulating process.

In the pressurizing/depressurizing method, the excessive pressurizing inside the pressurization buffer tank may be prevented by stopping the pressurizing/pressure accumulating when the inside of the pressurization buffer tank is pressurized so as to be a second pressure value which is high. In addition, it is possible to minimize a time necessary until a positive pressure is accumulated in the pressurization buffer tank, and to efficiently perform the pressurizing/pressure accumulating process.

In the pressurizing/depressurizing method, deaeration in which air is removed from liquid may be performed as the pressurizing. In addition, pressurizing cleaning in which liquid in a nozzle is discharged by pressurizing liquid may be performed as the pressurizing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
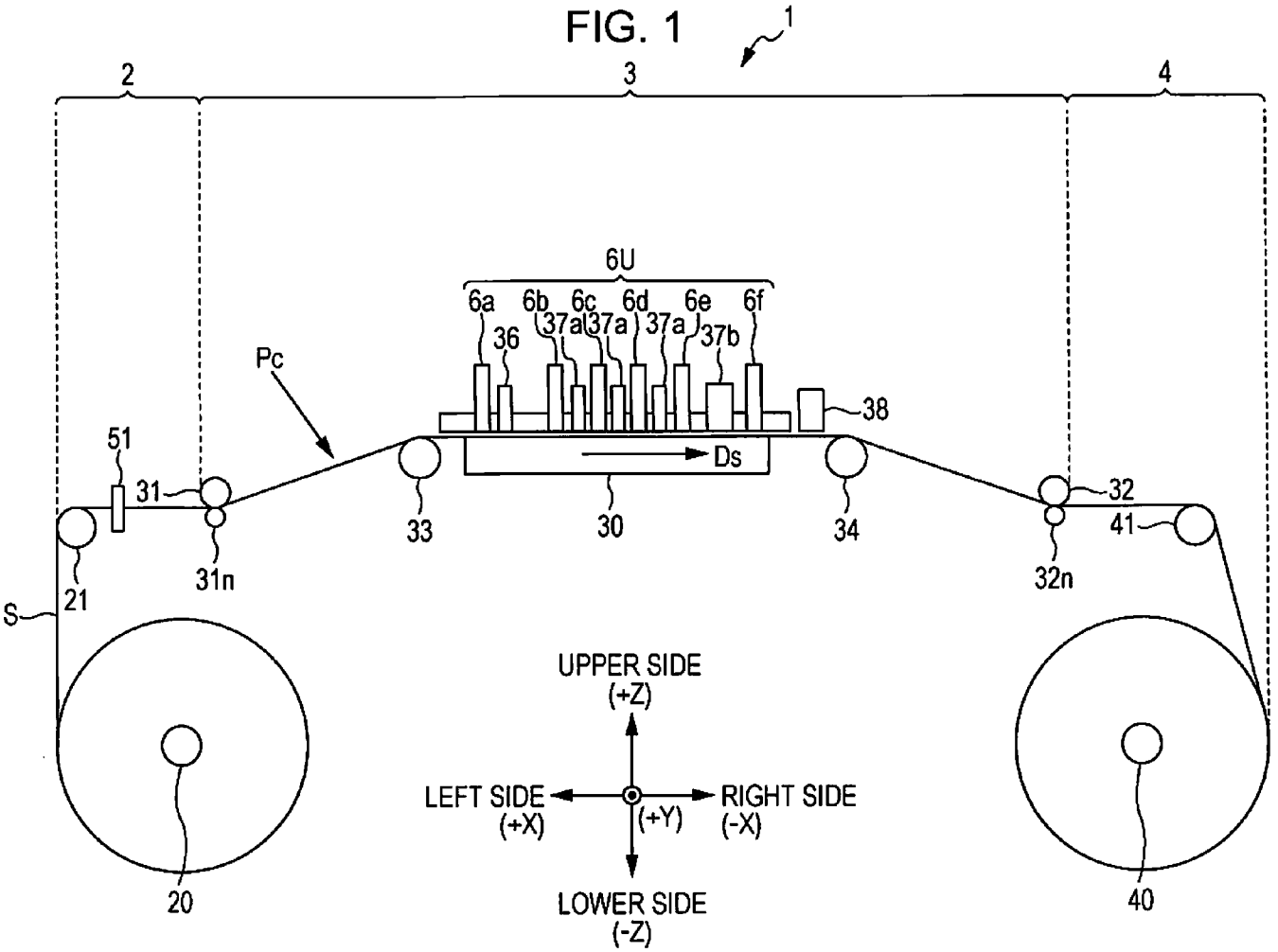
FIG. 1 is a front view which schematically illustrates a configuration of a printer according to a first embodiment of a liquid ejecting apparatus of the invention.

FIG. 1 is a front view which schematically illustrates a configuration of a printer according to a first embodiment of a liquid ejecting apparatus of the present invention. In addition, in FIG. 1, or in the following figures, a three-dimensional coordinate system corresponding to a horizontal direction X, a front/rear direction Y, and a vertical direction Z of the printer 1 is adopted as necessary in order to make a relation in arrangement of each unit of the printer 1 clear.

As illustrated in FIG. 1, a feeding unit 2, a process unit 3, and a winding unit 4 are arranged in the horizontal direction in the printer 1. The feeling unit 2 and the winding unit 4 include a feeding axis 20 and a winding axis 40, respectively. In addition, both ends of a sheet S (medium) are wound around in a roll shape around the feeding unit 2 and the winding unit 4, and are stretched therebetween. In this manner, the sheet S is transported to the process unit 3 from the feeding axis 20 along a transport path Pc which is stretched, and is subjected to an image recording process using a printing unit 6U, and is transported to the winding axis 40 thereafter. A type of the sheet S is roughly classified into a sheet type and a film type.

The feeding unit 2 includes the feeding axis 20 around which the end of the sheet S is wound, and a driven roller 21 which winds the sheet S which is pulled out from the feeding axis 20 therearound. When the feeding axis 20 rotates, the sheet S which is wound around the feeding axis 20 is drawn out to the process unit 3 by passing through the driven roller 21.

The process unit 3 records an image on the sheet S using the printing unit 6U while supporting the sheet S which is drawn out from the feeding unit 2 using a platen 30. That is, the printing unit 6U includes a plurality of print heads 6*a* to 6*f* which are aligned along the front surface of the platen 30, and an image is recorded on the sheet S when the print heads 6*a* to 6*f* eject ink on the sheet S which is supported on the front surface of the platen 30. In the process unit 3, a front driving roller 31 and a rear driving roller 32 are provided on both ends of the platen 30, and the sheet S which is transported from the front driving roller 31 to the rear driving roller 32 is subjected to printing of an image by being supported by the platen 30.

Driven rollers 33 and 34 are provided on both horizontal ends of the platen 30, and the driven rollers 33 and 34 wind up the sheet S which is transported from the front driving roller 31 to the rear driving roller 32 from the rear surface side.

A nipping roller 31*n* is provided to the front driving roller 31. The nipping roller 31*n* can reliably perform transporting of the sheet S using the front driving roller 31 by interposing the sheet S between the nipping roller and the front driving roller 31.

Similarly, a nipping roller 32*n* is provided to the rear driving roller 32.

In this manner, the sheet S which is transported from the front driving roller 31 to the rear driving roller 32 is transported in the transport direction Ds on the platen 30 while being supported by the platen 30. In addition, the plurality of print heads 6*a* to 6*f* which eject ink with respect to the front surface of the sheet S which is supported by the platen 30 using an ink jet method are arranged in the transport direction Ds while facing the front surface of the platen 30 in the process unit 3. In the respective print heads 6*a* to 6*f*, a plurality of nozzles form a nozzle column by aligning in a linear shape in the Y direction which is orthogonal to the transport direction Ds, and a plurality of nozzle columns are aligned at intervals in the transport direction Ds. Accordingly, the respective print heads 6*a* to 6*f* can record a line image with a plurality of lines at the same time. In addition, the print heads 6*a* to 6*f* eject ink of a corresponding color using an ink jet method while facing the front surface of the sheet S which is supported by the platen 30 with a little clearance.

The print heads 6*b* to 6*e* among the print heads form a color image by respectively ejecting inks of yellow (Y), cyan (C), magenta (M), and black (K). In addition, the print head 6*a* which is arranged on the upstream side in the transport direction Ds (left hand side in FIG. 1) rather than the print head 6*b* ejects ink of white (W), and prints a background of a color image (hereinafter, referred to as "background image") which is formed using the print heads 6*b* to 6*e*. In addition, the print head 6*f* which is arranged on the downstream side in the transport direction Ds (right hand side in FIG. 1) rather than the print head 6*e* ejects transparent ink, and transparent ink is further ejected to the color image and the background image.

Incidentally, ultraviolet (UV) ink which is cured by being irradiated with ultraviolet rays (light) (photocurable ink) is used as the ink. Therefore, according to the embodiment, a UV lamp 36 for a background image, UV lamps 37*a* and 37*b* for a color image, and a UV lamp 38 for transparent ink are provided. That is, the UV lamps 36, 37*a*, 37*b*, and 38 fix each ink onto the sheet S by curing thereof.

In this manner, in the process unit 3, ejecting and curing of ink is appropriately performed with respect to the sheet S which is supported by the platen 30, and a color image with a background image which is coated with the transparent ink, for example, is formed. In addition, the sheet S on which the color image is formed is transported to the winding unit 4 using the rear driving roller 32.

The winding unit 4 includes the winding axis 40 around which the end of the sheet S is wound, and a driven roller 41 which winds up the sheet S which is transported to the winding axis 40. When the winding axis 40 rotates, the sheet S is wound around the winding axis 40 by passing through the driven roller 41.

Figure 2:
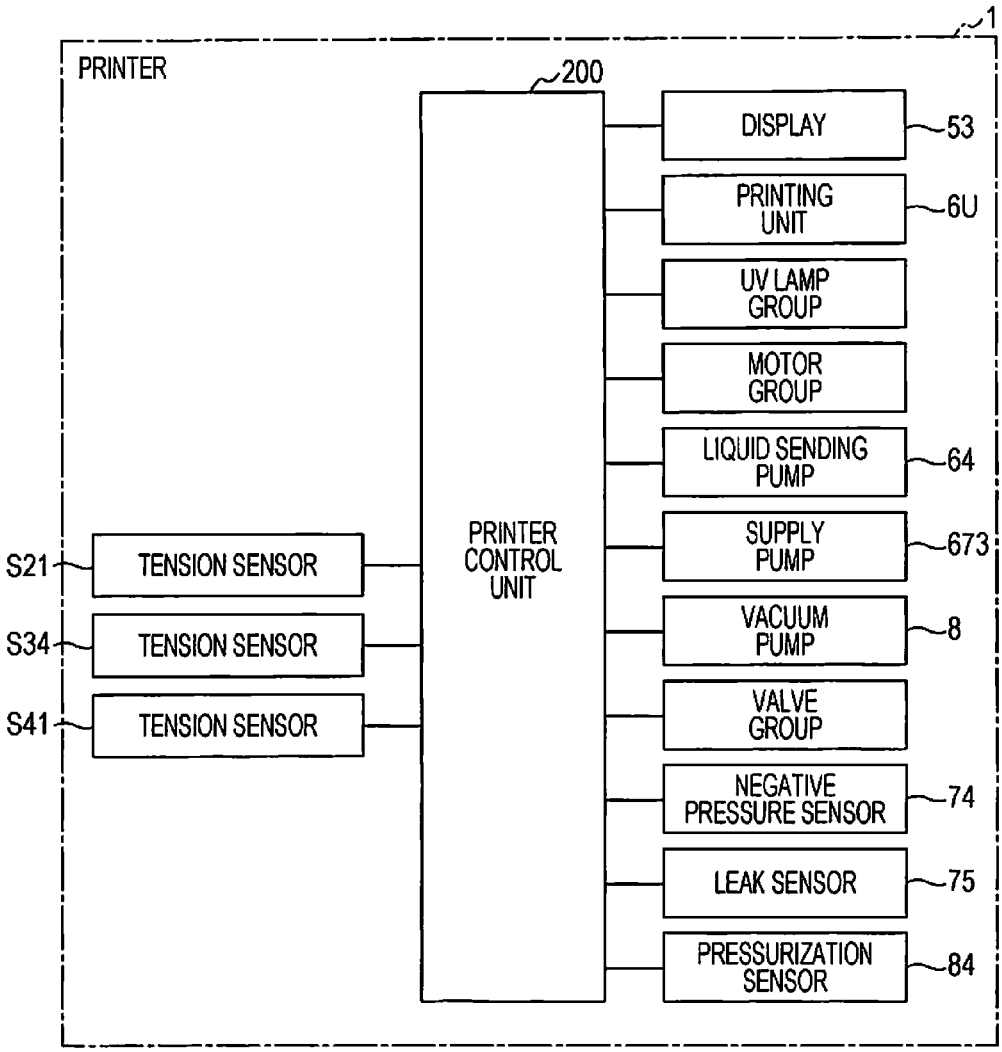
FIG. 2 is a block diagram which schematically illustrates an electrical configuration which controls the printer in FIG. 1.

Hitherto, an outline of a mechanical configuration of the printer 1 has been described. Subsequently, an electrical configuration which controls the printer 1 will be described. FIG. 2 is a block diagram which schematically illustrates the electrical configuration which controls the printer illustrated in FIG. 1. A printer control unit 200 which controls each unit of the printer 1 according to a command from an external host computer, or the like, is provided in the printer 1. In addition, each unit of the apparatus such as the print head, the UV lamp, a sheet transporting system, and an ink supply system is controlled by the printer control unit 200. Detailed control of the printer control unit 200 with respect to each unit of the apparatus is as follows.

The printer control unit 200 manages a function of controlling a transport of the sheet S which is described in detail using FIG. 1. That is, motors are connected to the respective feeding axis 20, the front driving roller 31, the rear driving roller 32, and the winding axis 40 among members which configure the sheet transport system. In addition, the printer control unit 200 controls the transport of the sheet S by controlling a speed or torque of each motor while rotating the motor group.

In addition, the printer control unit 200 controls operations of the print heads 6*a* to 6*f* of the printing unit 6U, or operations of the UV lamps 36, 37*a*, 37*b*, and 38 according to a transport state of the sheet S on the platen 30.

In addition, a display 53 as a user interface is provided in the printer 1. The display 53 is configured of a touch panel and has an input function which receives an input from a user in addition to a display function which performs a display with respect to the user. In addition, the printer control unit 200 displays various information or commands on the display 53, and controls each unit of the printer 1 according to the input from the user.

Hitherto, the outline of the electrical configuration of the printer 1 has been described. Meanwhile, in the printer 1 according to the embodiment, the printing unit 6U is equipped with a deaeration unit with respect to the ink supply mechanism in order to remove bubbles from ink which is used in the print head 6*a* to 6*f*. In addition, the printer control unit 200 performs deaeration processing by controlling each unit of the ink supply mechanism. In addition, though descriptions are omitted in the above descriptions, a maintenance unit which performs maintenance with respect to nozzles of the print head 6 is provided. In addition, a pressurizing cleaning process as one type of the maintenance is performed when the printer control unit 200 controls each unit of the ink supply mechanism. In particular, according to the embodiment, the deaeration processing and the pressurizing cleaning process are performed using a single pump. Therefore, hereinafter, a configuration of the print heads 6*a* to 6*f* will be described, and a configuration and operations of the ink supply mechanism which supplies ink to the print heads 6*a* to 6*f* will be described. In addition, when indicating any one of print heads 6*a* to 6*f* with no distinction thereof, it is denoted by a print head 6, and descriptions of the ink supply mechanism will be made based on the print head 6.

Figure 3:
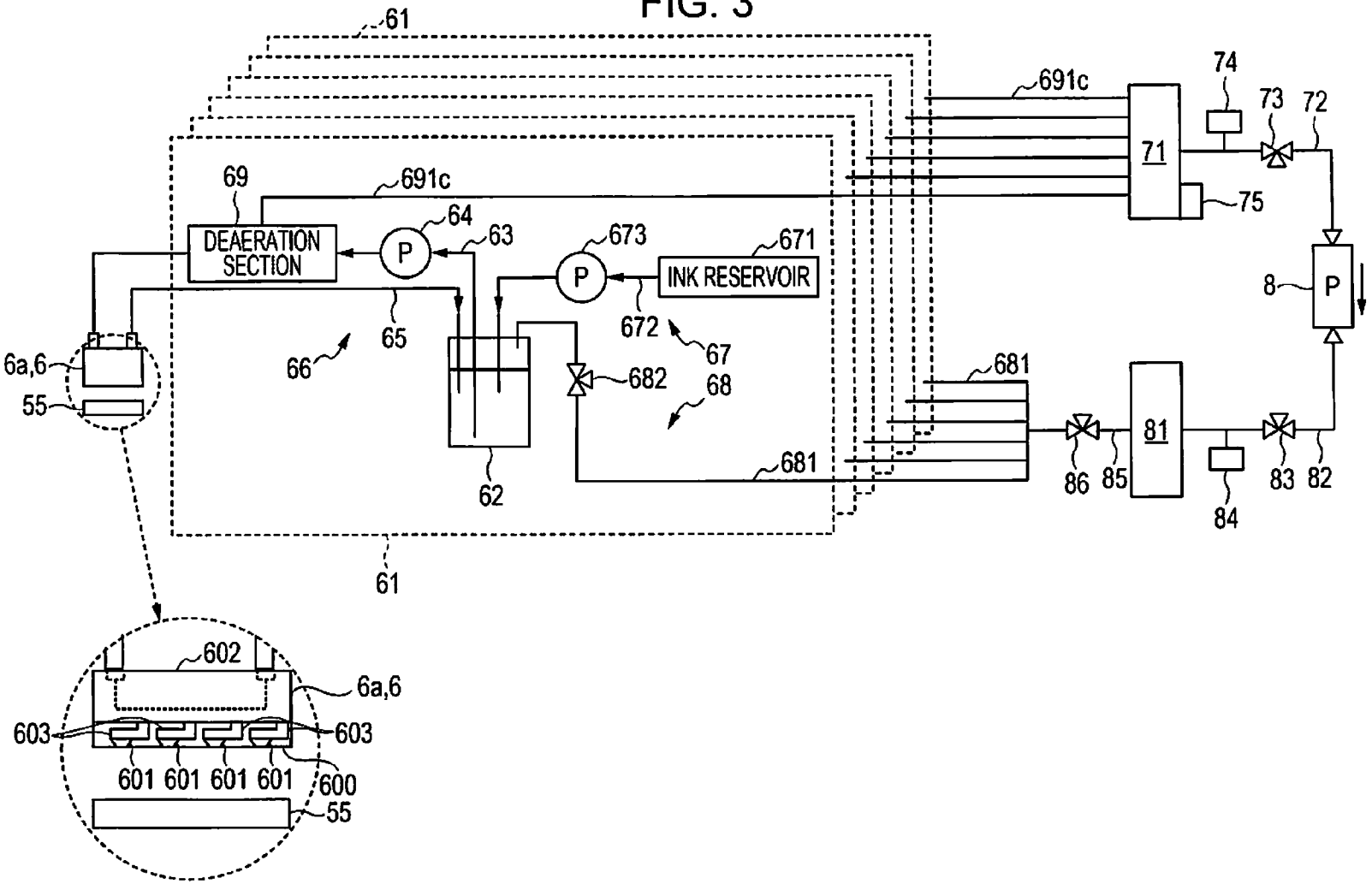
FIG. 3 is a diagram which schematically illustrates configuration examples of a print head and an ink supply mechanism.
Figure 4:
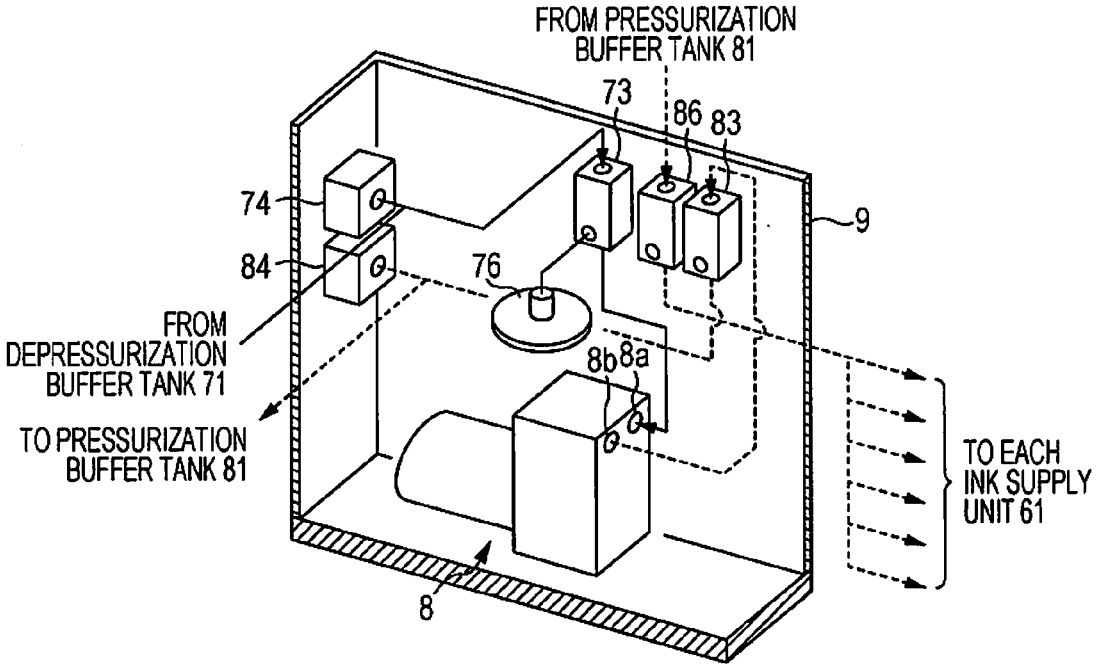
FIG. 4 is a partial perspective view which illustrates a part of the ink supply mechanism.

FIG. 3 is a diagram which schematically illustrates configuration examples of the print head and the ink supply mechanism. In addition, FIG. 4 is a partial perspective view which illustrates a part of the ink supply mechanism. The print head 6 includes a nozzle 601 which is open to a nozzle formation face 600, a reservoir 602 which temporarily stores ink, and a cavity 603 which connects the nozzle 601 and the reservoir 602, and ink is supplied to the nozzle 601 from the reservoir 602 through the cavity 603. In addition, ink is ejected from the nozzle 601 when the cavity 603 applies a pressure to the ink according to an operation command from the printer control unit 200 (FIG. 2).

A reference numeral 55 in the figure denotes the maintenance unit which performs a type of maintenance with respect to the nozzle 601 of the print head 6. The maintenance unit 55 is adjacently provided with respect to the platen 30 in the Y direction. In addition, each print head 6 is movably provided in the Y direction between the upper part of the platen 30 and the upper part of the maintenance unit 55, the print head 6 is located on the upper part of the platen 30 when performing a printing operation, and in contrast, the print head 6 is located on the upper part of the maintenance unit 55 when performing a maintenance. In addition, since a unit described in JP-A-2012-086409, for example, is known as the maintenance unit 55, detailed descriptions will be omitted here.

An ink supply unit 61 is provided in each of print heads 6*a* to 6*f*, and a supply of ink is controlled according to an operation command of the printer control unit 200 in the ink supply mechanism. The ink supply units 61 basically have the same configuration except for the number of deaeration units, which is different, as will be described later. That is, the ink supply unit 61 (corresponding to "supply unit" of invention) includes a tank 62 which reserves ink (corresponding to "reservoir" of invention), a supply flow path 63 (supply tube) which connects the tank 62 and the reservoir 602 of the print head 6, a liquid sending pump 64 which is provided in the supply flow path 63, and a collecting flow path 65 (collecting tube) which connects the reservoir 602 of the print head 6 and the tank 62. In this manner, a circulation path 66 on which ink flows to the tank 62, the supply flow path 63, the reservoir 602 of the print head 6, the collecting flow path 65, and the tank 62 are formed in this order. For this reason, when the liquid sending pump 64 rotates in the forward direction according to a rotation command from the printer control unit 200, ink circulates on the circulation path 66. That is, the ink which is reserved in the tank 62 is supplied to the print head 6 through the supply flow path 63 (going path) using the liquid sending pump 64, and is collected in the tank 62 from the print head 6 through the collecting flow path 65 (return path).

In addition, the ink supply unit 61 includes an ink supply mechanism 67 which supplies ink to the tank 62, and a pressure adjusting mechanism 68 which adjust a pressure in the tank 62. The ink supply mechanism 67 includes an ink reservoir 671 which can perform an exchange of an ink cartridge, an ink pack, or the like, or a refill, a supply flow path 672 (supply tube) which connects the ink reservoir 671 and the tank 62, and a supply pump 673 which is provided in the supply flow path 672. In addition, the ink in the ink reservoir 671 is supplied to the tank 62 through the ink supply flow path 672 when the supply pump 673 rotates in the forward direction according to a supply command from the printer control unit 200.

In addition, the pressure adjusting mechanism 68 includes a pressurization path (pressurizing pipe) 681, which connects a pressurization buffer tank which will be described later, the tank 62, and a three way valve 682 which is provided in the pressurization path 681. In addition, a pressure in the tank 62 is adjusted when the three way valve 682 is operated according to a valve switching command from the printer control unit 200. That is the three way valve 682 has a function of switching a path from the pressurization buffer tank to the tank 62, and a path which guides atmospheric air to the tank 62, and can select each path according to a switching command from the printer control unit 200. For example, when being switched to the path from the pressurization buffer tank to the tank 62, a pressure in the tank 62 increases due to the pressurization buffer tank. In contrast to this, when being switched to the path which guides atmospheric air to the tank 62, the inside of the tank 62 is open in the atmosphere, and returns to an atmospheric pressure.

In addition, according to the embodiment, a deaeration section 69 is provided in order to remove a gas component such as bubbles which are included in ink. That is, the deaeration section 69 is provided with respect to the liquid sending pump 64 on the downstream side in the ink supply direction on the supply flow path 63, in addition to the liquid sending pump 64, and ink which is supplied to the print head 6 is subjected to deaeration using the deaeration unit (not illustrated).

Here, when a gas component at the same level is included in any ink, the deaeration section 69 in each ink may have the same configuration, however, when an amount of the gas component is different, it is preferable to differentiate a deaeration performance according to a type of ink (color, composition, or the like). According to the embodiment, since white ink is used in order to form a background image, the deaeration performance is increased by increasing the number of deaeration units compared to other deaeration sections 69, only in the deaeration section 69 for the white ink. The reason is that the white ink includes a material having high sedimentation characteristics compared to other ink, is subjected to sufficient agitation in advance, and as a result, the white ink includes more bubbles than other inks. Due to such a technical background, according to the embodiment, for example, six deaeration units are used only for the deaeration section 69 for white ink, in contrast to, for example, four deaeration units being used in the deaeration section 69 other than for the white ink. In addition, as the deaeration unit, it is possible to use, for example, a unit which is configured so that a plurality of gas transmission films are arranged in an internal space of a vacuum chamber, and UV ink flows in the gas transmission film, and is configured so that a negative pressure is supplied to the vacuum chamber. As a matter of course, the configuration of the deaeration unit is not limited to this, and it is possible to use a unit which can perform deaeration with respect to the UV ink using the negative pressure of the depressurization buffer tank which will be described later as the deaeration unit.

As illustrated in FIG. 3, each deaeration section 69 is connected to a depressurization buffer tank 71 through a negative pressure supply path 691*c* (corresponding to "depressurization path" of the invention). The depressurization buffer tank 71 has a columnar shape, for example, and can accumulate a negative pressure in an internal space thereof. The depressurization buffer tank 71 is connected to a vacuum pump 8 using a negative pressure introducing path (pipe) 72. In addition, the negative pressure introducing path 72 is provided with a three way valve 73. In the three way valve 73, a port which is connected to an inlet port 8*a* of the vacuum pump 8 (refer to FIG. 4) is a common port, and a port which is connected to atmospheric air among remaining ports (hereinafter, referred to as "atmosphere opening port on depressurizing side") is normally open, and in contrast to this, a port which is connected to the depressurization buffer tank 71 (hereinafter, referred to as "opening/closing port on depressurizing side") is normally shut off. In addition, when the three way valve 73 is in an ON state according to a valve switching command from the printer control unit 200, and is switched to a depressurization position, a path from the depressurization buffer tank 71 to the vacuum pump 8 is selected in the three way valve 73. On the other hand, when the three way valve 73 is in an OFF state according to a valve switching command, and is switched to the depressurization stop position, a path on which the vacuum pump 8 is connected to the depressurization buffer tank 71 is shut off, and a path which introduces atmospheric air to the inlet port side of the vacuum pump 8 is selected. In this manner, the three way valve 73 functions as a depressurization switching valve which switches depressurizing and stopping of depressurizing using the depressurization buffer tank 71. Hereinafter, the three way valve 73 will be referred to as the "depressurization switching valve" in the specification.

A negative pressure sensor 74 is provided in the vicinity of the depressurization buffer tank 71 in order to measure a pressure in the depressurization buffer tank 71. In addition, a leak sensor 75 is arranged so as to face the lower side of a side face of the depressurization buffer tank 71, and when ink flows into an internal space of the depressurization buffer tank 71, it is possible for the leak sensor 75 to detect leaking of the ink.

In addition, according to the embodiment, a pressurization buffer tank 81 is provided in addition to the depressurization buffer tank 71. The pressurization buffer tank 81 has the same configuration as that of the depressurization buffer tank 71 and can accumulate a positive pressure in an internal space thereof. That is, the pressurization buffer tank 81 is connected to the vacuum pump 8 using a pressurization introducing path (pipe) 82. In addition, a three way valve 83 is provided on the pressurization introducing path 82. In the three way valve 83, a port which is connected to an outlet port 8*b* of the vacuum pump 8 (refer to FIG. 4) is a common port, and a port which is connected to atmospheric air among remaining ports (hereinafter, referred to as "atmosphere opening port on pressurizing side") is normally open, however, in contrast to this, a port which is connected to the pressurization buffer tank 81 (hereinafter, referred to as "opening/closing port on pressurizing side") is normally shut off. In addition, when the three way valve 83 is in an ON state according to a valve switching command from the printer control unit 200, and is switched to a pressurization position, a path from the vacuum pump 8 to the pressurization buffer tank 81 is selected in the three way valve 83. On the other hand, when the three way valve 83 is in an OFF state according to a valve switching command, and is switched to the pressurization stop position, a path on which the vacuum pump 8 is connected to the pressurization buffer tank 81 is shut off, and a path on which a positive pressure (compressed air) from the vacuum pump 8 is released to atmospheric air is selected. In this manner, the three way valve 83 functions as a pressurization switching valve which switches pressurizing and a stop of pressurizing using the pressurization buffer tank 81. Hereinafter, the three way valve 83 will be referred to as the "pressurization switching valve" in the specification. In addition, a sensor for pressurization 84 for measuring a pressure in the pressurization buffer tank 81 is provided in the vicinity of the pressurization buffer tank 81.

One end of a common pressurization path (pipe) 85 is connected to the pressurization buffer tank 81. The other end of the common pressurization path 85 is branched into six paths, and each branching path functions as a pressurization path 681. In addition, a three way valve 86 is provided in the common pressurization path 85. In the three way valve 86, a port which is connected to the pressurization buffer tank 81 is a common port, and a port which is connected to atmospheric air among remaining ports is normally shut off, and in contrast to this, a port which is connected to the three way valve 682 of the pressure adjusting mechanism 68 is normally open. In addition, when the three way valve 86 is in an OFF state according to a valve switching command from the printer control unit 200, and is switched to a pressurization position, a path from the pressurization buffer tank 81 to the three way valve 682 is selected in the three way valve 86. On the other hand, when the three way valve 86 is in an ON state according to a valve switching command, and is switched to a pressurizing release position, a path on which the pressurization buffer tank 81 is connected to the pressure adjusting mechanism 68 is shut off, and a path on which air from the pressurization buffer tank 81 is released to atmospheric air is selected. In this manner, the three way valve 86 functions as a pressurization releasing valve which switches pressurizing of the tank 62 and releasing of the pressurizing. Hereinafter, the three way valve 86 will be referred to as the "pressurization releasing valve" in the specification.

In addition, according to the embodiment, as illustrated in FIG. 4, an accommodating box (accommodating unit) 9 is provided. In addition, the vacuum pump 8, components on the vacuum pump 8 side with respect to the depressurization buffer tank 71 (negative pressure introducing path 72, three way valve 73, negative pressure sensor 74), and components on the vacuum pump 8 side with respect to the pressurization buffer tank 81 (pressurization introducing path 82, three way valve 83, pressurization sensor 84) are integrally accommodated in the accommodating box 9, and accordingly, miniaturization of the apparatus is performed. A reference numeral 76 in FIG. 4 is a filter.

In the printer 1 which is configured in this manner, the print head 6 is located on the upper part of the platen 30 when performing a printing operation. In addition, ink in the tank 62 is supplied to the print head 6 when the printer control unit 200 controls each unit of the apparatus in this state, and formation of a background image and a color image, and coating using transparent ink are executed.

In addition, the deaeration section 69 is connected to the depressurization buffer tank 71 through a negative pressure supply path 691*c*, and deaeration processing is performed when a negative pressure which is accumulated in the depressurization buffer tank 71 is supplied to each deaeration unit.

In addition, when a user issues a command through the display 53, when there is power input, or the like, a pressurizing cleaning process as one type of maintenance is executed when the printer control unit 200 controls each unit. When performing maintenance, the print head 6 is located on the upper part of the maintenance unit 55. In addition, a rotational speed of the liquid sending pump 64 is accelerated up to a fixed acceleration speed in the forward direction. The acceleration speed is higher than a normal speed at a time of a printing operation. In addition, the nozzle 601 is pressurized from the tank 62 through the collecting flow path 65 due to the pressurization buffer tank 81 when the maintenance unit 55 performs capping of a nozzle formation surface 600, and the tank 62 is pressurized due to the pressurization buffer tank 81. Ink in the nozzle 601 is ejected to the maintenance unit 55 when the capping is released thereafter. In addition, bubbles and the like of the nozzle 601 are discharged from the nozzle 601 along with the ink which is ejected from the nozzle 601. Subsequent to this, wiping with respect to the nozzle formation surface 600 is performed. In this manner, ink which is ejected from the nozzle 601 and is attached to the nozzle formation surface 600 is wiped off. Subsequently, a rotational speed of the liquid sending pump 64 (circulating speed) is deceased to a normal speed, flushing is performed, and ink is filled in the entire nozzle 601. When the flushing ends in this manner, the pressurizing cleaning is ended.

Pressures in the depressurization buffer tank 71 and the pressurization buffer tank 81 fluctuate every time such a deaeration process (depressurizing process) or the pressurizing cleaning process (pressurizing process) is performed, however, it is possible to stably perform the deaeration process and the pressurizing cleaning process since capacities of the depressurization buffer tank 71 and the pressurization buffer tank 81 are sufficient compared to an amount of fluctuation in every process, and there is no rapid fluctuation in pressure. However, it is certain that there is fluctuation, and depressurizing of the tank 71 and the pressurizing of the tank 81 are necessary at any timing. Therefore, according to the embodiment, each unit of the apparatus is controlled as illustrated in FIG. 5 based on detection results of the negative pressure sensor 74 and the pressurization sensor 84, and pressure values in the depressurization buffer tank 71 and the pressurization buffer tank 81 are adjusted so as to be values which are appropriate to the deaeration process and the pressurizing cleaning process, respectively.

Figure 5:
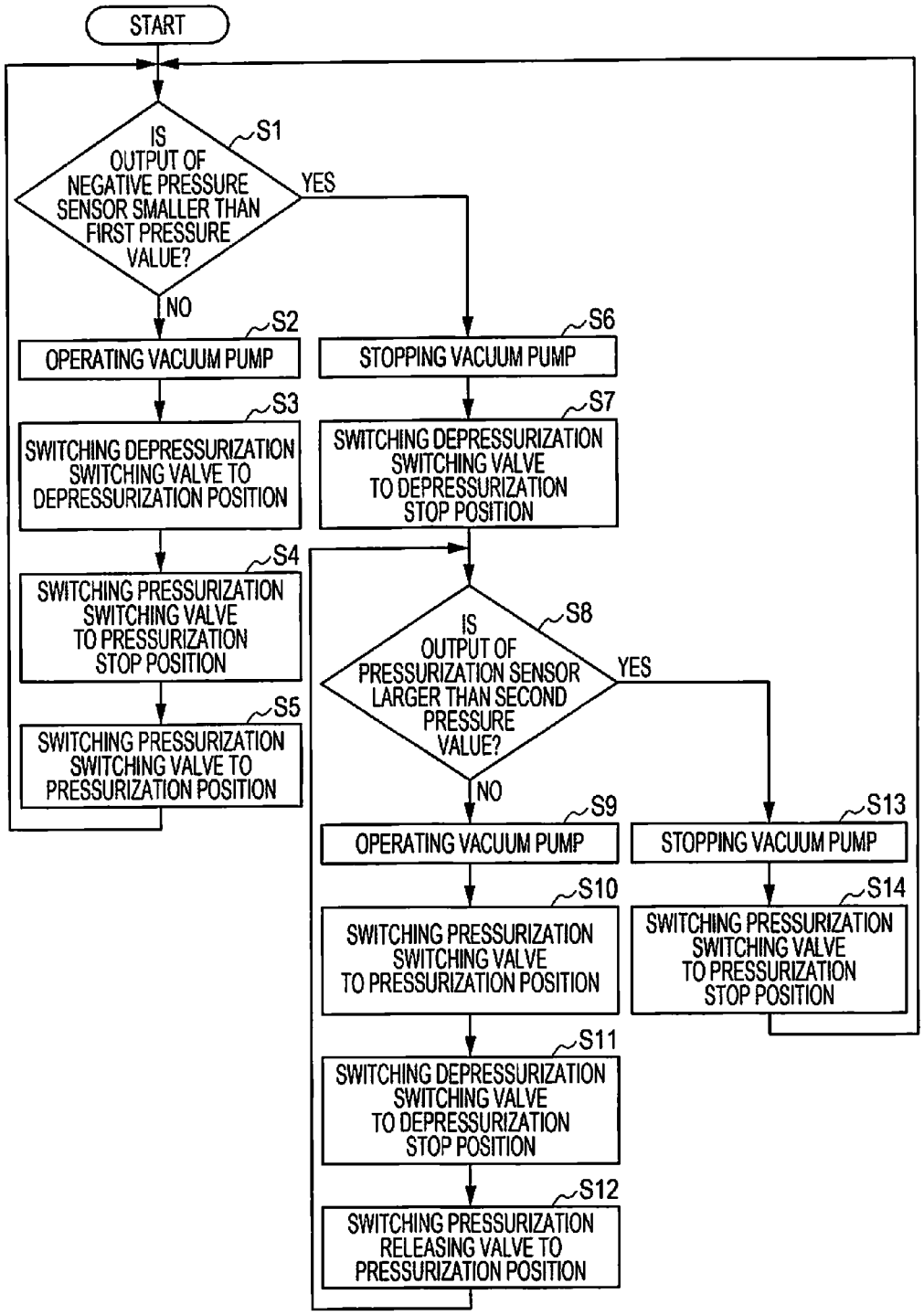
FIG. 5 is a flowchart which illustrates an example of a pressurizing/depressurizing operation which is executed in the printer in FIG. 1.
Figure 6:
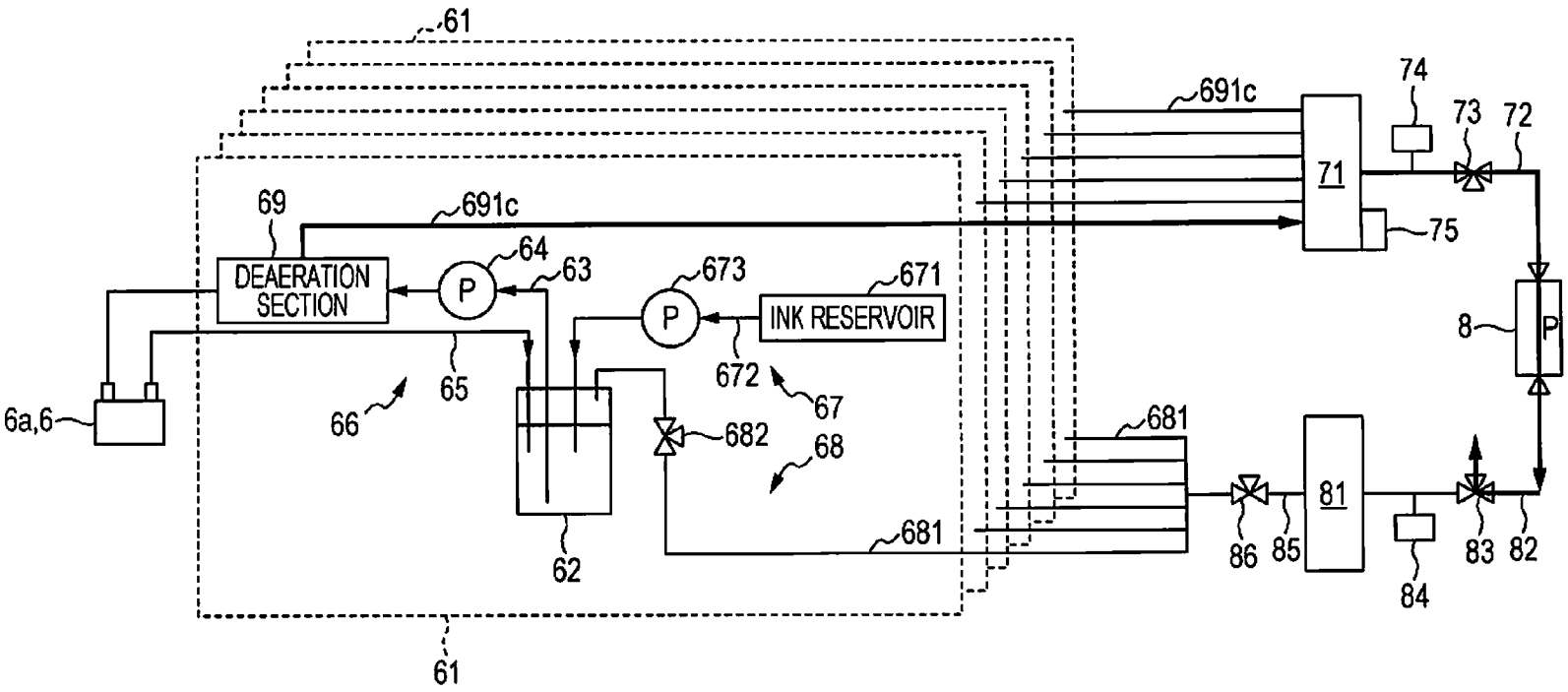
FIG. 6 is a diagram which schematically illustrates a depressurizing/pressure accumulating operation and a deaeration operation in the printer in FIG. 1.
Figure 7:
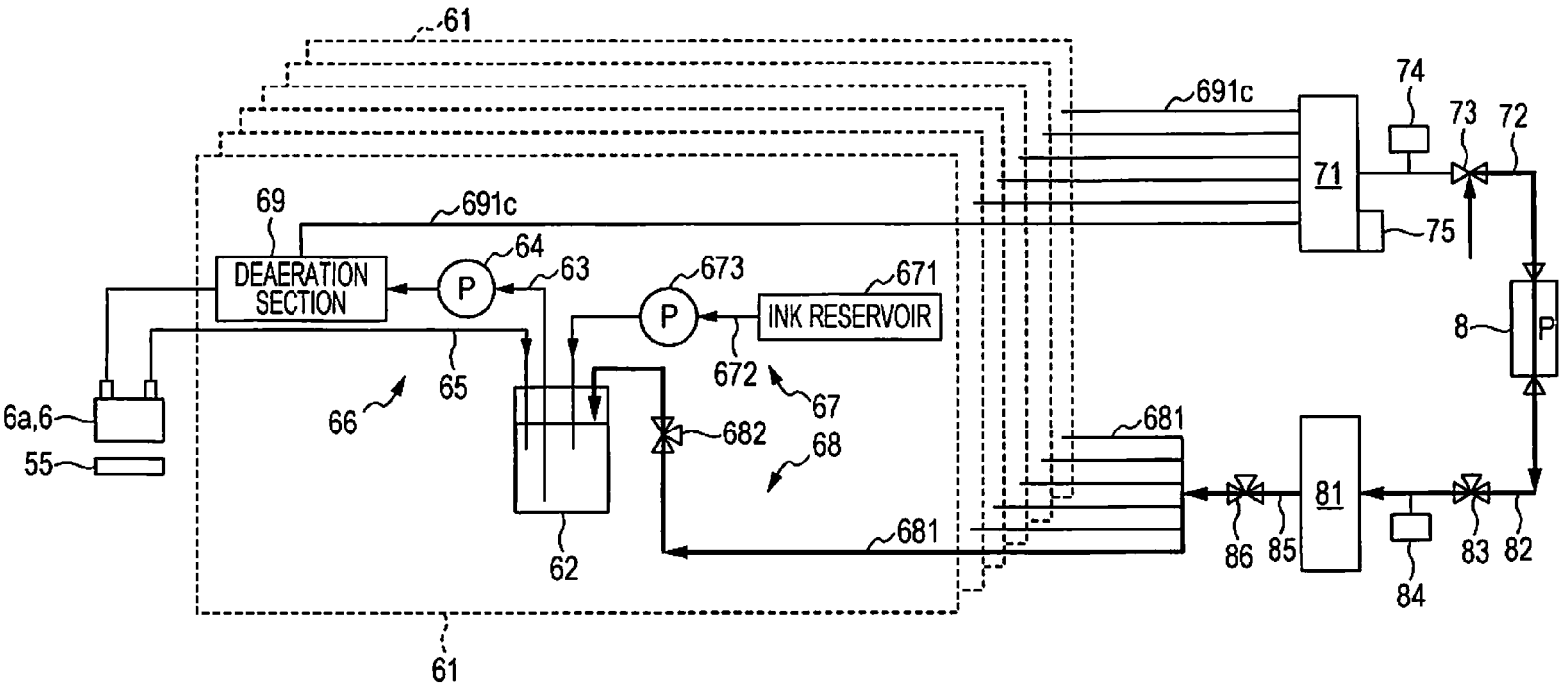
FIG. 7 is a diagram which schematically illustrates a pressurizing/pressure accumulating operation and a pressurizing cleaning operation in the printer in FIG. 1.

FIG. 5 is a flowchart which illustrates an example of a pressurizing/depressurizing operation which is executed in the printer 1 in FIG. 1. In addition, FIG. 6 is a diagram which schematically illustrates a depressurizing/pressure accumulating operation and a deaeration operation in the printer in FIG. 1. In addition, FIG. 7 is a diagram which schematically illustrates a pressurizing/pressure accumulating operation and a pressurizing cleaning operation in the printer 1 in FIG. 1. In the printer 1, the printer control unit 200 controls each unit of the apparatus according to a program which is stored in a memory (not illustrated), and repeatedly performs the depressurizing/pressure accumulating process (steps S1 to S7) with respect to the depressurization buffer tank 71 based on a detection result of the negative pressure sensor 74, and the pressurizing/pressure accumulating process (steps S8 to S14) with respect to the pressurization buffer tank 81 based on a detection result of the pressurization sensor 84 alternately.

In the depressurizing/pressure accumulating process, whether or not a detection value of the negative pressure sensor 74, that is, a pressure value in the depressurization buffer tank 71, is lower than a first pressure value (<atmospheric pressure) which is appropriate for the deaeration process is determined (step S1). In addition, when it is "NO" in step S1, that is, when the inside of the depressurization buffer tank 71 is not depressurized up to the first pressure value, an operation of the vacuum pump 8 is started (step S2).

Subsequent to this, a depressurization switching valve 73 enters an ON state according to a valve switching command, and is switched to a depressurization position (step S3). Due to this, as illustrated in FIG. 6, the depressurization buffer tank 71 is depressurized through the negative pressure introducing path 72. Meanwhile, on the pressurization buffer tank 81 side, a pressurization switching valve 83 enters an OFF state, and is switched to a pressurization stop position (step S4). In this manner, pressurizing of the tank 81 using the vacuum pump 8 is not performed and air from the vacuum pump 8 is released to atmospheric air through the atmosphere opening port on the pressurizing side of the pressurization switching valve 83, thereby preventing an excessive application of pressure with respect to the vacuum pump 8.

In the subsequent step S5, a pressurization releasing valve 86 enters an OFF state, and is switched to a pressurization position. Accordingly, when the three way valve 682 of the pressure adjusting mechanism 68 is switched to the pressurization position at appropriate timing, the tank 62 is pressurized using the pressurization buffer tank 81 even while depressurizing/pressure accumulating is performed, and the pressurizing process can be performed.

In this manner, the vacuum pump 8 depressurizes the depressurization buffer tank 71. Such depressurizing/pressure accumulating is repeated until it is determined to be "Yes" in step S1, and the pressure in the depressurization buffer tank 71 is slowly decreased.

When it is confirmed that a pressure value in the depressurization buffer tank 71 is lower than the first pressure value ("Yes" in step S1), the operation of the vacuum pump 8 is stopped (step S6). In addition, the depressurization switching valve 73 enters an OFF state along with the stop of the vacuum pump 8, and is switched to the depressurization stop position (step S7). In this manner, the depressurization buffer tank 71 and the vacuum pump 8 are shut off due to the depressurization switching valve 73, and the inlet port 8*a* side of the vacuum pump 8 is open to atmospheric air.

When the depressurizing/pressure accumulating process ends, the pressurizing/pressure accumulating process is executed (steps S8 to S14). In the pressurizing/pressure accumulating process, whether or not a detection value of the pressurization sensor 84, that is, a pressure value in the pressurization buffer tank 81, is higher than the second pressure value (>atmospheric pressure) which is appropriate for the pressurizing cleaning process (step S8) is determined. In addition, when it is "NO" in step S8, that is, when the inside of the pressurization buffer tank 81 is not pressurized up to the second pressure value, the operation of the vacuum pump 8 is started (step S9).

Subsequent to this, the pressurization switching valve 83 enters an ON state according to a valve switching command, and is switched to the pressurization position (step S10). Due to this, as illustrated in FIG. 7, the pressurization buffer tank 81 is pressurized through the pressurization introducing path 82. Meanwhile, on the depressurization buffer tank 71 side, the depressurization switching valve 73 enters an OFF state, and is switched to the depressurization stop position (step S11). In this manner, the depressurization buffer tank 71 and the vacuum pump 8 are shut off due to the depressurization switching valve 73 and air is supplied to the inlet port side of the vacuum pump 8 through the atmosphere opening port on the depressurizing side of the depressurization switching valve 73, thereby preventing an excessive application of pressure with respect to the vacuum pump 8.

In the subsequent step S12, the pressurization releasing valve 86 enters an OFF state and is switched to the pressurization position. Accordingly, when the three way valve 682 of the pressure adjusting mechanism 68 is switched to the pressurization position at appropriate timing, as denoted by a thick line in FIG. 7, the tank 62 is pressurized using the pressurization buffer tank 81 even while the pressurizing/pressure accumulating process is performed, and pressurizing process can be performed.

In this manner, the pressurization buffer tank 81 is pressurized using the vacuum pump 8. Such pressurizing/pressure accumulating is repeated until it is determined to be "Yes" in step S8, and the pressure in the pressurization buffer tank 81 is slowly increased.

When it is confirmed that the pressure value in the pressurization buffer tank 81 is higher than the second pressure value ("Yes" in step S8), the operation of the vacuum pump 8 is stopped (step S13). In addition, in the state in which the vacuum pump 8 is stopped, the pressurization switching valve 83 is switched to the pressurization stop position (step S14). In this manner, the pressurization buffer tank 81 and the vacuum pump 8 are shut off due to the pressurization switching valve 83, and the outlet port 8*b* side of the vacuum pump 8 is open to atmospheric air.

As described above, according to the embodiment, it is possible to perform the deaeration process by accumulating a negative pressure in the depressurization buffer tank 71 in advance, and depressurizing the deaeration section 69 using the depressurization buffer tank 71. Accordingly, it is not necessary to constantly operate the vacuum pump 8, and it is possible to suppress a pressure fluctuation during the depressurizing process. As a result, it is possible to perform a good and stable deaeration process. In addition, depressurizing and a stop of depressurization of the depressurization buffer tank 71 using the vacuum pump 8 are performed based on a detection result of the negative pressure sensor 74, using the depressurization switching valve 73. For this reason, a value of a negative pressure which is accumulated in the depressurization buffer tank 71, that is, an internal pressure of the depressurization buffer tank 71 can be accurately controlled. Accordingly, it is possible to depressurize ink with an appropriate value using the depressurization buffer tank 71, and to perform the deaeration process satisfactorily.

In addition, since it is configured so that the depressurizing/pressure accumulating process is stopped when the inside of the pressurization buffer tank 71 is depressurized so as to be the first pressure value, it is possible to prevent the inside of the depressurization buffer tank 71 from being excessively depressurized. In addition, it is possible to minimize a time which is necessary until a negative pressure necessary for the deaeration process is accumulated in the depressurization buffer tank 71, and to improve efficiency in the depressurizing/pressure accumulating process.

In addition, similarly to the depressurizing, it is possible to pressurize ink at appropriate timing using the pressurization buffer tank 81 by accumulating a positive pressure in advance in the pressurization buffer tank 81 in the pressurizing. For this reason, it is possible to perform a good and stable pressurizing cleaning process. In addition, pressurizing and a stop of pressurizing using the pressurization buffer tank 81 are performed using the pressurization switching valve 83 based on a detection result of the pressurization sensor 84. For this reason, it is possible to accurately control a value of the positive pressure which is accumulated in the pressurization buffer tank 81, that is, an internal pressure of the pressurization buffer tank 81. Accordingly, it is possible to pressurize ink using the pressurization buffer tank 81 using an appropriate value, and to preferably perform the pressurizing cleaning process.

In addition, since it is configured so that the pressurizing/pressure accumulating process is stopped when the inside of the pressurization buffer tank 81 is pressurized so as to be the second pressure value, it is possible to prevent the inside of the pressurization buffer tank 81 from being excessively pressurized. In addition, it is possible to minimize a time necessary until a positive pressure necessary for the pressurizing cleaning process is accumulated in the pressurization buffer tank 81, and to improve efficiency in the pressurizing/pressure accumulating process.

In addition, according to the embodiment, the above described deaeration process and the pressurizing cleaning process are executed by pressurizing the nozzle 601 of the print head 6 using a single vacuum pump 8. Accordingly, it is not necessary to prepare the pump for depressurizing and the pump for pressurizing, and it is possible to minimize the printer 1 which executes the deaeration process and the pressurizing cleaning process and to suppress a cost of the apparatus.

Second Embodiment

According to the first embodiment, the pressurizing cleaning process is performed as the "pressurizing process" of the invention, however, the "pressurizing process" of the invention is not limited to this. Hereinafter, this point will be described based on a second embodiment.

Figure 8:
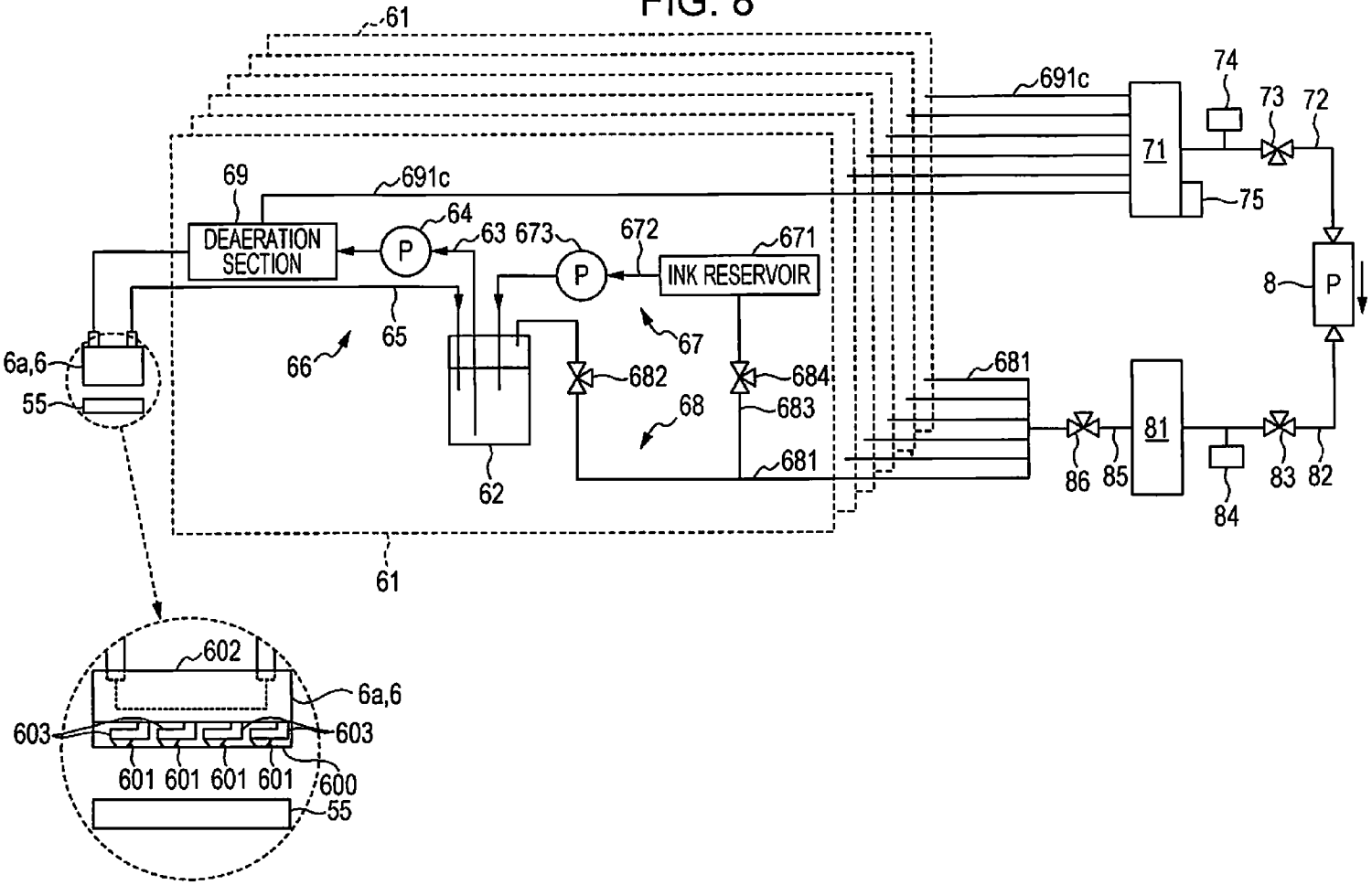
FIG. 8 is a diagram which illustrates a configuration of a second embodiment of the liquid ejecting apparatus according to the invention.
Figure 9A:
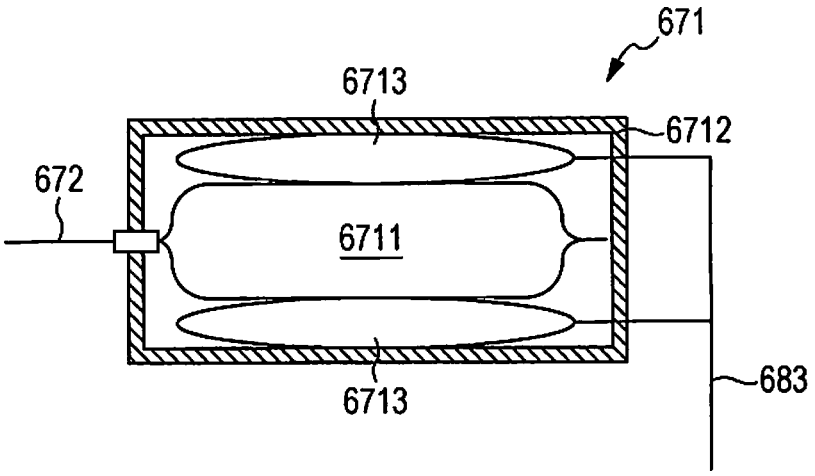
FIGS. 9A and 9B are diagrams which illustrate a configuration of an ink reservoir.
Figure 9B:
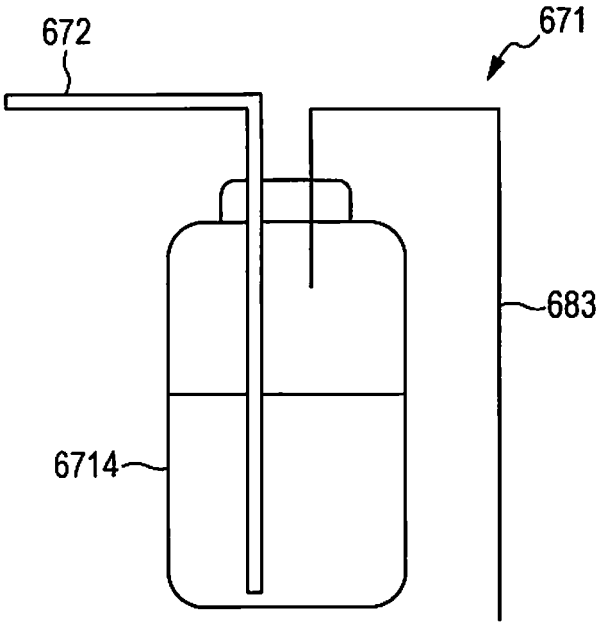

FIG. 8 is a diagram which illustrates a configuration of a printer which is the second embodiment of the liquid ejecting apparatus according to the invention. In addition, FIGS. 9A and 9B are diagrams which illustrate a configuration of an ink reservoir. A big difference in the second embodiment from the first embodiment is that a configuration of pressurizing the ink reservoir 671 in the pressure adjusting mechanism 68 is added, and configurations other than that are the same as those of the first embodiment.

The ink reservoir 671 is provided as an ink pack 6711 as illustrated in FIG. 9A, for example. The ink pack 6711 is accommodated in a housing 6712 in a state of being interposed between two air bags 6713. In addition, each air bag 6713 is connected to a branched pressurization path (pipe) 683 which is branched from the pressurization path 681, and can be pressurized using the pressurization buffer tank 81. A three way valve 684 is inserted into the branched pressurization path 683. In the three way valve 684, a port which is connected to the air bag 6713 is a common port, and a port which is connected to atmospheric air among remaining ports is normally open, however, in contrast to this, a port which is connected to the pressurization path 681 is normally closed. In addition, when supplying ink, extrusion of the ink is performed by blowing up the air bag 6713 by pressurizing the air bag 6713 using the pressurization buffer tank 81 when an atmosphere opening port is closed, and the port which is connected to the pressurization path 681 is open. In addition, when the ink supply is not performed, the air bag 6713 returns to a normal state and is open to the atmosphere.

As described above, according to the second embodiment, the pressure adjusting mechanism 68 uses pressurizing using the pressurization buffer tank 81 not only for pressurizing cleaning, but also for ink supplying, and the ink supply process is executed as "pressurizing process" of the invention. Accordingly, not only the same operational effect as that in the first embodiment, but also a separate operational effect in which it is possible to preferably perform the ink supply by pressurizing ink using the pressurization buffer tank 81 is obtained. In addition, it is possible to obtain a separate operation effect in which it is possible to preferably perform the ink supply process as one mode of the pressurizing process using a single vacuum pump 8.

In addition, according to the second embodiment, the ink reservoir 671 is provided as the ink pack 6711, however, even when the ink reservoir 671 is provided as an ink bottle 6714 as illustrated in FIG. 9B, the ink reservoir may be configured so as to be pressurized using the pressurization buffer tank 81 through a branched pressurization path 683.

Third Embodiment

According to the first embodiment, the deaeration process using the deaeration section 93 is performed as the "depressurizing process" of the invention, however, the "depressurizing process" of the invention is not limited to this. Hereinafter, this point will be described based on a third embodiment.

Figure 10:
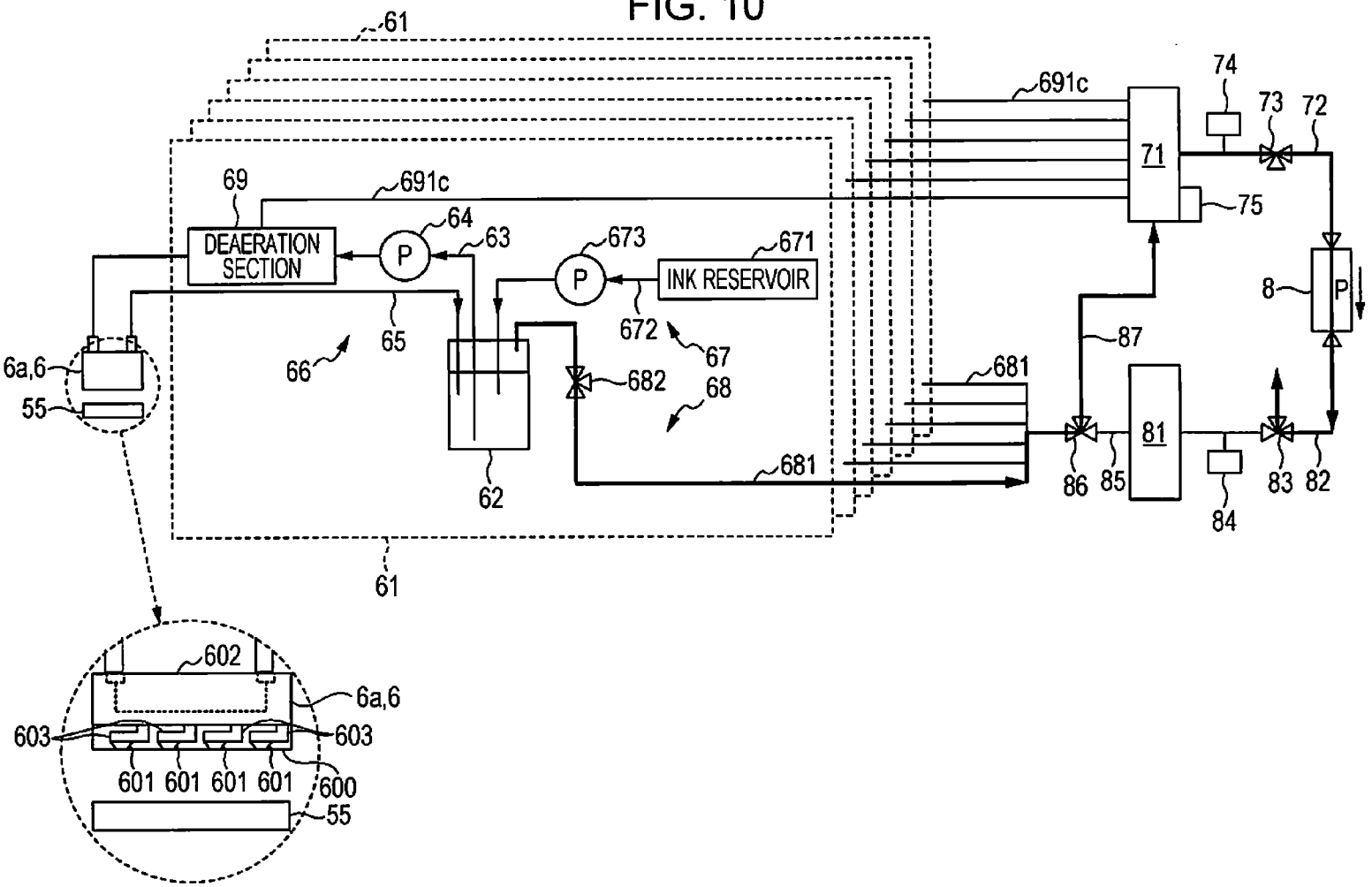
FIG. 10 is a diagram which illustrates a configuration of a third embodiment of the liquid ejecting apparatus according to the invention.

FIG. 10 is a diagram which illustrates a configuration of a printer which is the third embodiment of the liquid ejecting apparatus according to the invention. A big difference in the third embodiment from the first embodiment is that the three way valve 86 also functions as a depressurization control valve, not only a pressurization releasing valve. More specifically, a point that a port which is used as the atmosphere opening port among ports of the three way valve 86 in the first embodiment is connected to the depressurization buffer tank 71 through the depressurization path 87, and operations of the three way valve 86 are different from those of the first embodiment, and configurations other than that are the same as those of the first embodiment.

According to the third embodiment, opening and closing of the three ports which configure the three way valve 86 are controlled by the printer control unit 200 according to an operational condition of the printer 1. In addition, in order to describe the operation, a port which is connected to the depressurization buffer tank 71 is referred to as a "port on the depressurizing side", a port which is connected to the pressurization buffer tank 81 is referred to as a "port on the pressurizing side", and a port which is connected to the tank 62 which functions as a reservoir is referred to as a "port on the reservoir side" among the three ports.

When the pressurizing cleaning process is performed, the port on the depressurizing side, the port on the pressurizing side, and the port on the reservoir side enter a "closed state", an "open state", and an "open state", respectively, and the tank 62 is pressurized using the pressurization buffer tank 81.

On the other hand, when a suction cleaning process is performed, the port on the depressurizing side, the port on the pressurizing side, and the port on the reservoir side enter an "open state", a "closed state", and an "open state", respectively, and the tank 62 is depressurized using the depressurization buffer tank 71, as illustrated in FIG. 10. That is, in the suction cleaning, the inside of the tank 62 is depressurized so as to be at a negative pressure (for example, negative pressure of −20 kPa to −70 kPa) due to depressurizing of the tank 62 using the depressurization buffer tank 71 in a state in which the ink supply from the supply flow path 63 to the reservoir 602 is shut off. As a result, the inside of the nozzle 601 is depressurized through the collecting flow path 65 from the tank 62, and the ink is suctioned from the nozzle 601. As a result, bubbles, or the like, which are not discharged from the nozzle 601 using the pressurizing cleaning, flow out from the nozzle 601 along with the sucked ink.

As described above, according to the third embodiment, depressurizing using the depressurization buffer tank 71 is also used for suction cleaning, not only for the deaeration, and the suction cleaning process is executed as the "depressurizing process" of the invention. Accordingly, not only the same operational effect as that of the first embodiment, but also a separate operational effect that it is possible to preferably perform the suction cleaning using depressurizing, using the depressurization buffer tank 71, can be obtained. In addition, a separate operational effect that it is possible to preferably perform the suction cleaning process as one mode of the depressurizing process can be obtained using a single vacuum pump 8.

Others

In the above described first to third embodiments, the ink supply unit 61 corresponds to an example of the "supply unit" of the invention. In addition, the depressurization switching valve 73 and the pressurization switching valve 83 correspond to the "first switching unit" and the "second switching unit" of the invention, respectively.

In addition, the invention is not limited to the above described embodiments, and it is possible to appropriately combine elements in the above described embodiments or add various modifications without departing from the scope of the invention. For example, in the above described embodiments, the depressurizing/pressure accumulating process and the pressurizing/pressure accumulating process are alternately performed, however, a configuration in which only one of the depressurizing/pressure accumulating process and the pressurizing/pressure accumulating process is executed according to detection results of the sensors 74 and 84 may be adopted. Alternatively, a configuration in which both of the processes are performed in parallel may be adopted. That is, it is possible to perform the depressurizing/pressure accumulating process and the pressurizing/pressure accumulating process in parallel by switching the depressurization switching valve 73 to the depressurization position, and switching the pressurization switching valve 83 to the pressurization position, and to reduce a total time which is needed in the pressurizing/pressure accumulating with respect to the pressurization buffer tank 81, and in the depressurizing/pressure accumulating with respect to the depressurization buffer tank 71.

In addition, it is possible to appropriately change the arrangements or the number of the print heads 6 or UV lamps, or to appropriately change the shape, or the like, of the platen 30.

In addition, the deaeration process is performed by depressurizing the deaeration unit of the deaeration section 69, however, the deaeration process may be performed in the tank 62 by depressurizing the tank 62.

In addition, it is also possible to appropriately change the specific configuration of each unit of the printer 1, and for example, the configuration of the print head 6 may be changed from the above described configuration. In addition, according to the embodiments, ink is circulated, however, the liquid ejecting technology according to the invention can be applied to a printer in which a circulation of ink is not performed.

According to the embodiment, an ink jet printer using UV ink is adopted, however, a liquid ejecting apparatus which ejects or discharges liquid other than UV ink may be adopted. It may be adapted for use in various liquid ejecting apparatuses which include a liquid ejecting head, or the like, which ejects minute amounts of liquid droplets. In addition, the liquid droplets mean a state of liquid which is ejected from the liquid ejecting apparatus, and include a granular shape, a tear shape, or a thread shape leaving a trail. In addition, the liquid here may be a material which can be ejected by the liquid ejecting head. For example, the material may include, not only liquid as a state of the material, buy also a material in a state of liquid phase, materials which flow such as a liquid body having high or low viscosity, sol, gel water, and an inorganic solvent, an organic solvent, liquid, a liquid resin, liquid metal (metallic melt) other than that, or materials in which particles of a functional material which is formed of a solid body such as a pigment or metal particles are melted, diffused, or mixed in a solvent. In addition, as a representative example of the liquid, the ink, liquid crystal, or the like can be exemplified as described in the above embodiments. Here, the ink includes general water-based ink and oil-based ink, and a variety of liquid compositions such as gel ink, hot-melt ink, UV curable ink, or the like. As specific examples of the liquid ejecting apparatus, there may be a liquid ejecting apparatus which ejects liquid including a material such as an electrode material, or a color material which is used when manufacturing, for example, a liquid crystal display, an EL (electroluminescence) display, a surface emission display, a color filter, or the like in a form of dispersion or dissolution, a liquid ejecting apparatus which ejects a biological organic substance which is used when manufacturing a biochip, a liquid ejecting apparatus which ejects liquid as a sample which is used as a precision pipette, a textile printing device, a micro-dispenser, or the like. Further, the liquid ejecting apparatus may be a liquid ejecting apparatus which ejects a lubricant to a precision machine such as a clock, a camera, or the like, using a pinpoint, a liquid ejecting apparatus which forms a micro bulls-eye (optical lens) which is used in an optical communication element, or the like, a liquid ejecting apparatus which ejects an etching liquid such as an acid or an alkali for etching a substrate, or the like, and a liquid ejecting apparatus for textile printing which ejects liquid on cloth, or the like. In addition, it is possible to apply the invention to any one of these liquid ejecting apparatuses.

This application claims priority to Japanese Patent Application No. 2013-194739 filed on Sep. 20, 2013. The entire disclosure of Japanese Patent Application No. 2013-194739 is hereby incorporated herein by reference.

What is claimed is:

1. A pressurizing/depressurizing method of a liquid ejecting apparatus which includes a print head which ejects liquid, and a supply unit which supplies the liquid to the print head, the method comprising:

depressurizing/pressure accumulating in which a depressurization buffer tank is depressurized, and a pressure is accumulated;

pressurizing/pressure accumulating in which a pressurization buffer tank is pressurized, and a pressure is accumulated;

depressurizing in which the liquid is depressurized so that a pressure is lower than an atmospheric pressure in the supply unit using the depressurization buffer tank; and pressurizing in which the liquid is pressurized so that the pressure is higher than the atmospheric pressure in the supply unit using the pressurization buffer tank, the depressurizing/pressure accumulating in the depressurization buffer tank and the pressurizing in the supply unit being performed in parallel.

2. The pressurizing/depressurizing method of a liquid ejecting apparatus according to claim 1, wherein, in the depressurizing/pressure accumulating, an inside of the depressurization buffer tank is depressurized using a single pump, and wherein, in the pressurizing/pressure accumulating process, an inside of the pressurization buffer tank is pressurized using the pump.

3. The pressurizing/depressurizing method of a liquid ejecting apparatus according to claim 2, wherein a first switching unit which switches between a depressurization position at which an inlet port of the pump and the depressurization buffer tank are communicated and a depressurization stop position at which the inlet port of the pump and an atmospheric pressure are communicated, and a second switching unit which switches between a pressurization position at which an outlet port of the pump and the pressurization buffer tank are communicated and a pressurization stop position at which the outlet port of the pump and an atmospheric pressure are communicated are provided, wherein, in the depressurizing/pressure accumulating, the pump is driven by switching the first switching unit to the depressurization position, and wherein, in the pressurizing/pressure accumulating, the pump is driven by switching the second switching unit to the pressurization position.

4. The pressurizing/depressurizing method of a liquid ejecting apparatus according to claim 3, wherein, when the pressurizing/pressure accumulating is executed while the depressurizing/pressure accumulating is stopped, the first switching unit is switched to the depressurization stop position, and the second switching unit is switched to the pressurization position.

5. The pressurizing/depressurizing method of the liquid ejecting apparatus according to claim 3, wherein, when the pressurizing/pressure accumulating is stopped while the depressurizing/pressure accumulating is executed, the first switching unit is switched to the depressurization position, and the second switching unit is switched to the pressurization stop position.

6. The pressurizing/depressurizing method of the liquid ejecting apparatus according to claim 1, wherein, when an inside of the depressurization buffer tank is depressurized so as to be a first pressure value, the depressurizing/pressure accumulating is stopped.

7. The pressurizing/depressurizing method of the liquid ejecting apparatus according to claim 1, wherein, when an inside of the pressurization buffer tank is pressurized so as to be a second pressure value, the pressurizing/pressure accumulating is stopped.

8. The pressurizing/depressurizing method of the liquid ejecting apparatus according to claim 1, wherein the depressurizing is deaeration in which gas is removed from the liquid.

9. The pressurizing/depressurizing method of the liquid ejecting apparatus according to claim 1, wherein the pressurizing is pressurizing cleaning in which the liquid in the nozzle is discharged by being pressurized.

10. The pressurizing/depressurizing method of the liquid ejecting apparatus according to claim 1, wherein parallel processing of the pressurizing/pressure accumulating and the pressurizing is possible.

11. The pressurizing/depressurizing method of the liquid ejecting apparatus according to claim 1, wherein the depressurizing/pressure accumulating and the pressurizing/pressure accumulating is performed alternately.

12. A liquid ejecting apparatus comprising:

a print head which ejects liquid from nozzles;

a supply unit which supplies the liquid to the print head;

a depressurization buffer tank which accumulates a pressure by performing depressurizing;

a pressurization buffer tank which accumulates a pressure by performing pressurizing;

a depressurization path which communicates with the supply unit and the depressurization buffer tank;

a pressurization path which communicates with the supply unit and the pressurization buffer tank; and a control unit configured to control pressurizing and depressurizing of the depressurization buffer tank, the pressurization buffer tank, the depressurization path, and the pressurization path such that a pressure of liquid in the supply unit is depressurized so as to be lower than an atmospheric pressure using the depressurization buffer tank, and the pressure of the liquid in the supply unit is pressurized so as to be higher than the atmospheric pressure using the pressurization buffer tank, and the pressure is accumulated in the depressurization buffer tank by performing depressurizing in parallel with the pressurizing of the liquid in the supply unit.

* * * * *